United States Patent [19]

Stephenson et al.

[11] Patent Number: 4,750,880

[45] Date of Patent: Jun. 14, 1988

[54] COMPLIANT PRINT HEAD LOADING MECHANISM FOR THERMAL PRINTERS

[75] Inventors: Stanley W. Stephenson, Spencerport; William I. Morris, Oakfield, both of N.Y.

[73] Assignee: Eastman Kodak Company, Rochester, N.Y.

[21] Appl. No.: 118,665

[22] Filed: Nov. 9, 1987

[51] Int. Cl.[4] ..... B41J 3/20

[52] U.S. Cl. ..... 400/120; 346/76 PH; 400/55

[58] Field of Search ..... 400/120, 55, 56, 57, 400/58, 59; 346/76 PH

[56] References Cited

U.S. PATENT DOCUMENTS

| | | | |
|---|---|---|---|
| 3,845,850 | 11/1974 | Herr et al. . | |
| 4,000,393 | 12/1976 | Cochran et al. | 219/216 |
| 4,300,844 | 11/1981 | Keil | 400/120 |
| 4,458,253 | 7/1984 | Goff, Jr. et al. | 346/76 PH |
| 4,507,666 | 3/1985 | Kondo et al. | 400/120 X |
| 4,531,132 | 7/1985 | Wilkinson | 346/76 |
| 4,560,292 | 12/1985 | Takahashi | 400/59 |
| 4,563,692 | 1/1986 | Negita et al. | 346/76 |
| 4,625,218 | 11/1986 | Watanabe | 400/120 X |
| 4,710,040 | 12/1987 | Grey | 400/55 |
| 4,718,785 | 1/1988 | Spath | 400/120 |

FOREIGN PATENT DOCUMENTS

| | | | |
|---|---|---|---|
| 184867 | 9/1985 | Japan | 400/120 |
| 32765 | 2/1986 | Japan . | |

*Primary Examiner*—Charles Pearson

*Attorney, Agent, or Firm*—Raymond L. Owens

[57] ABSTRACT

A compliant head loading mechanism for a thermal printer which in a loaded condition compliantly loads a thermal head against a dye-carrier and a receiver to form a printing nip. The mechanism includes two brackets each of which is pivotably mounted on a fixed pivot shaft. A head loading spring connects the two brackets. The lower bracket has two arms which have holes that receive the pivot shaft. One hole permits only rotational motion of the lower bracket while the other hole is a slot that permits rotational and translation motion of the lower bracket. The slot is tilted to prevent the drag force exerted by the rotating roller against the media (dye-carrier and receiver) from the inducing a twisting moment into the lower bracket.

1 Claim, 4 Drawing Sheets

COMPLIANT PRINT HEAD LOADING MECHANISM FOR THERMAL PRINTERS

CROSS-REFERENCE TO RELATED APPLICATIONS

Reference is made to commonly assigned patent application Ser. No. 013,989 filed Feb. 12, 1987 to Mark J. Spath, now U.S. Pat. No. 4,718,785, and patent application Ser. No. 093,927 filed Sept. 8, 1987 to Steven J. Sparer et al.

FIELD OF THE INVENTION

The present invention relates to thermal printers and more specifically to a mechanism for controlling the position of the print head during a full printing cycle.

BACKGROUND OF THE INVENTION

In a typical thermal printer, a web-type carrier containing a repeating series of spaced frames of different colored heat transferable dyes is spooled on a supply spool. The carrier is paid out from the supply spool and rewound on a take-up spool. The carrier moves through a nip formed between a thermal print head and a dye-absorbing receiver. The receiver in turn is supported by a platen in the form of a drum. The print head engages the dye-carrier and presses it against the receiver. The receiver may, for example, be coated paper and the print head is formed of, for example, a plurality of heating elements. When a particular heating element is energized, it is heated. In the presence of heat and pressure, dye from the carrier is caused to transfer to the dye-receiver. The density or darkness of the printed color dye is a function of the energy delivered from the heating element to the carrier. These types of thermal printers offer the advantage of "true continuous tone" dye density transfer. This result is obtained by varying the energy applied to each heating element, yielding a variable dye density image pixel on the receiver.

The web-type carrier often includes a repeating series of spaced yellow, magenta and cyan dyes frames. The carrier is typically formed of a very thin, flexible dye carrying member having a thickness that can be on the order of ¼ mil. At the beginning of the print cycle, the head must be locked off the drum to allow a cut-sheet dye-receiver to be wrapped onto the drum and advanced under the head. This pre-printing process requires that the drum turn without the head or dye-carrier in contact with drum. To begin printing, the first dye patch, typically yellow, is advanced to a position under the print head. The print head is lowered to apply pressure on the carrier-donor sandwich as the platen turns. The media sandwich slides under the print head and the heating elements are selectively energized to form a row of yellow image pixels under the print head. The drum turns to generate successive rows of the yellow portion of the final image. When the yellow portion of the image has been deposited, the head is lifted to reposition the dye-receiver for the next color frame. The dye-carrier is controlled during the repositioning so that the next dry frame, for example magenta, is positioned under the print head. When the printer is ready for the second dye frame, the head is lowered to reestablish contact with the media, and the next color plane is deposited on the receiver. The process of head lift, receiver repositioning and preparation for the next dye patch is repeated for the final dye-frame, in this case the cyan frame. The three dyes are blended during the deposition process to generate a full-color image. After the three color portions of the image have been deposited, the printing process is completed. The head must be lifted again to allow the platen to turn and eject the completed image. The head must continue to be held up to reload the platen for the next cut sheet dye-receiver.

The process of applying the head to the drum must be done in a manner that allows the head to be positioned accuratley, repeatedly, and with uniform pressure across the platen to provide a high-quality print. The thermal head's linear array of heating elements should be positioned tangent to the drum and centered radially over the drum surface. In addition, the heating element array should be pressed against the drum surface with uniform force. Because manufactured parts vary from perfect dimension, the mechanism should be assigned to minimize the effect of these dimensional errors on print quality. The accuracy of the head position is ensured by minimizing the number of components between the drum and the head and in the shape and nature of each part's features. If this accuracy cannot be built into the head support mechanism, adjustments must be built in. Such adjustments add to the complexity and expense of the assembly. The repeatability of the mechanism is guaranteed if the head returns to the same position after a lift-and-lower cycle. If the head doesn't return to the same position for each of the dye layers, the resolution of the image will be degraded. It is preferable that the head must not only lift off of the drum during the printing, but that the head should be moved significantly out of the way for service procedures.

SUMMARY OF THE INVENTION

Accordingly, it is an object of this invention to provide an improved thermal print head compliant loading mechanism which minimizes the above noted problems.

This object is achieved in a thermal printer by a compliant head loading mechanism for a thermal printer which in a loaded condition compliantly loads a thermal head against a dye-carrier and a receiver mounted on a platen such as a drum to form a nip, comprising:

(a) a fixed pivot shaft;

(b) a lower bracket fixed securely to said thermal head and having two arms each having a hole that receives said pivot shaft to pivotably mount said lower bracket, one of said holes being a tight tolerance hole that only permits rotational motion of said lower bracket and the other hole being in the form of a slot with major and minor axes constructed to permit both rotational and translation motion of said lower bracket, said slot being configured such that a line extending from the nip and the center axis of said pivot shaft is perpendicular to said major slot axis;

(c) an upper bracket pivotably mounted on said pivot shaft and movable between unloaded and loaded positions;

(d) a rotatable cam member;

(e) a head loading spring fixedly connected between said upper and lower brackets and effective to urge said lower bracket into engagement with said cam member; and (f) said cam member being configured and located to move said print head into and out of a loaded condition, wherein said thermal head is compliantly loaded by said spring to form said nip, whereby the loading force is uniformly distributed across the nip and no twisting moment is induced in said lower bracket.

Features and Advantages of this Invention include:

Only two components are needed for mounting and loading the thermal head. These components are two brackets, one to hold the head, the other being movable between latched and unlatched conditions. A cam is used to lift the print head and a single pivot shaft allows the two brackets to pivot as one unit.

This invention permits highly accurate positioning of print heads. This is due to the print head position on the platen (drum surface) being done through the lower bracket. Elimination of intermediate parts reduces tolerance error stack-up, thus reducing positioning error.

The print head alignment with the drum is controlled by dimensional control of the lower bracket.

An advantage of this system over other mechanical head lift systems is that the print head readily can be lifted or lowered at any point in time. This feature can be useful for initialization functions and error recovery.

The slot in one arm of the lower bracket permits the print head to be uniformly loaded against the drum surface. This eliminates head contact pressure adjustments.

An important feature of the slot is the tilt used to compensate for twist induced by the drag force of the drum. If the force of the drag is sufficient it can introduce a twisting moment in the lower bracket. Instead of a uniform loading, this twist causes the load induced by the load spring to be biased. This variation in pressure across the nip causes a density variation across the print in the receiver. This undesirable effect is eliminated when the slot is oriented so that is perpendicular to a line drawn between the nip and the centerline of the pivot shaft. Based on this principle, the tilt of the slot can be readily determined.

Because the two brackets share a common pivot, they can be swung off the drum as a single unit to allow greater accessability to the printing area. The two parts return to the printing position virtually undisturbed. This ensures reliable positioning of the print head.

MODES OF CARRYING OUT THE INVENTION

Figure 1:
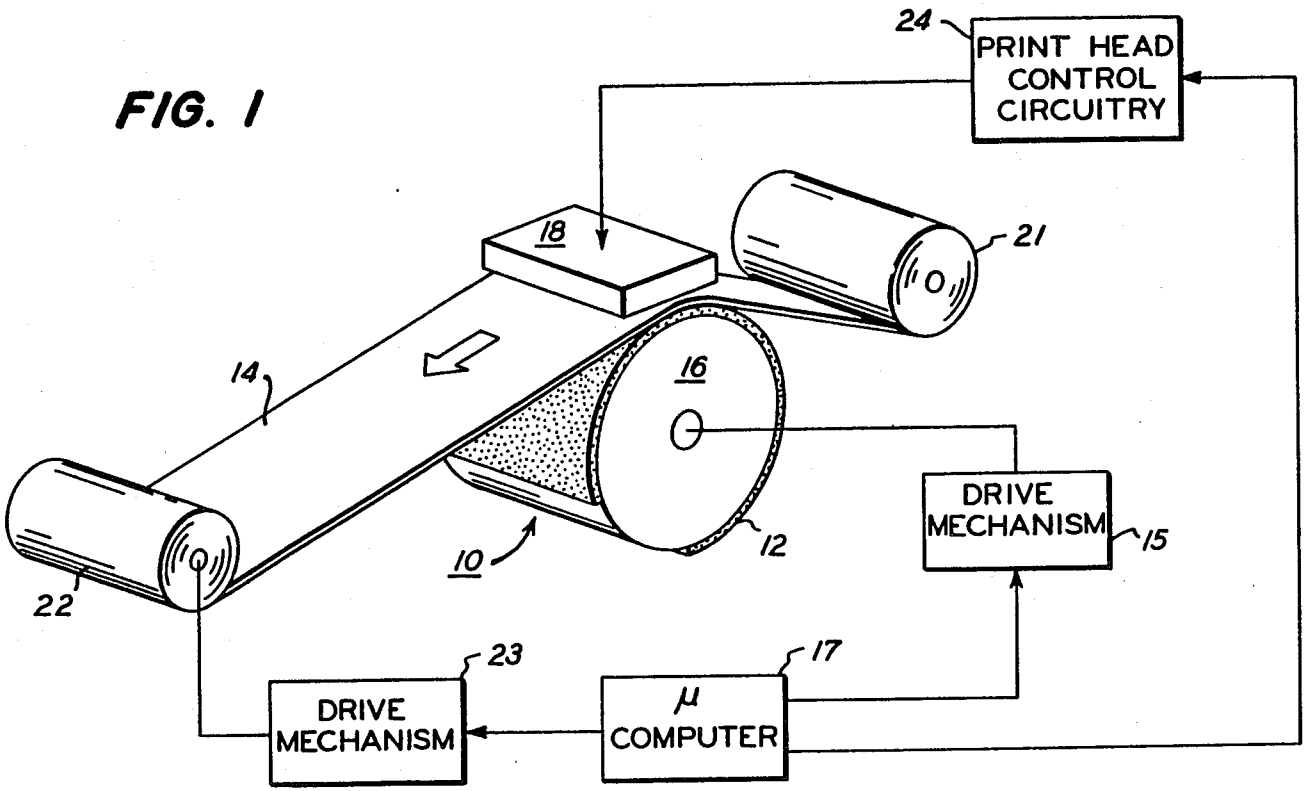
FIG. 1 is a schematic of a thermal printer apparatus which can be employed to make colored image in a receiver.

To facilitate an understanding of the present invention, reference is first made to FIG. 1 which shows a schematic of a thermal printer apparatus 10. The thermal printer apparatus 10 employs a receiving member in the form of a cut receiver sheet 12, which is secured by a clamp (not shown) to a rotatably drum 16. The drum 16 is driven by a drive mechanism 15. Drive mechanism 15 continuously rotates drum 16 and thus the successive portions of the receiver sheet 12 past a print head 18. For convenience of illustration, print head 18 has been shown as a block and the head loading mechanism in accordance with the present invention is illustrated in the remaining drawings. Thermal print head 18 is conventional and includes a plurality of heating elements (not shown). Compliant head loading mechanism presses the print head against a dye-carrier 14 and the receiver sheet mounted on the drum 16 to form a printing nip. The dye-carrier member 14 is mounted in a cartridge and is driven along path from a cartridge supply spool 21 into a take-up spool 22 by a drive mechanism 23. The mechanism 23 drives a gear (not shown) on the spool 22 which causes the dye-carrier to advance. During printing, the drive mechanism 15 continuously advances the receiver 12 and the carrier 14 (via frictional engagement with the receiver at the print head) relative to the line of heating elements of the print head as the heating elements are selectively energized by print head control circuitry 24. Microcomputer 17 controls the operation of the mechanism 15 and 23 as well as the print head control circuitry 24.

The dye-carrier 14 includes a repeating series of thermally transferable dyes. Each series typically may includes frames of yellow, magenta and cyan dye frames. A series of these three dye frames is used to print a full colored image on the receiver sheet 12. In this disclosure, the term "dye" refers to a colored material which transfer from the dye-carrier 14 to the receiver sheet 12 in response to energy applied by the individual heating elements of the print head 18.

Figure 3A:
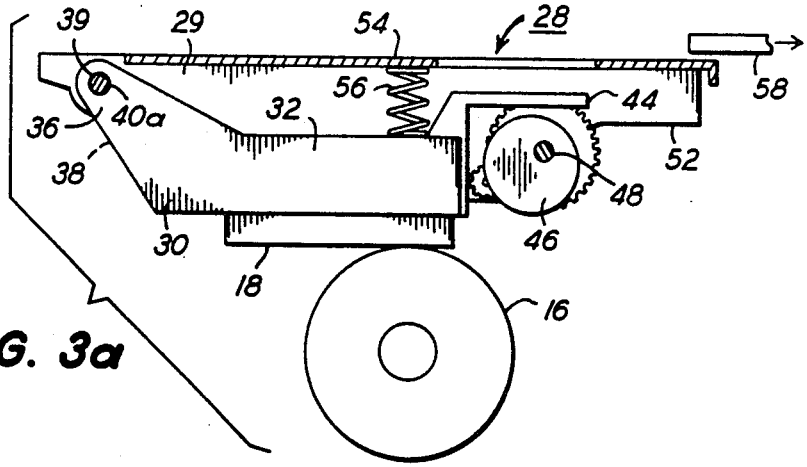
FIGS. 3*a–c* are views taken along the lines 3—3 of FIG. 2, showing the head loading mechanism in a "loaded" print position, a carrier advance position, and a mechanism servicing position, respectively.
Figure 3B:
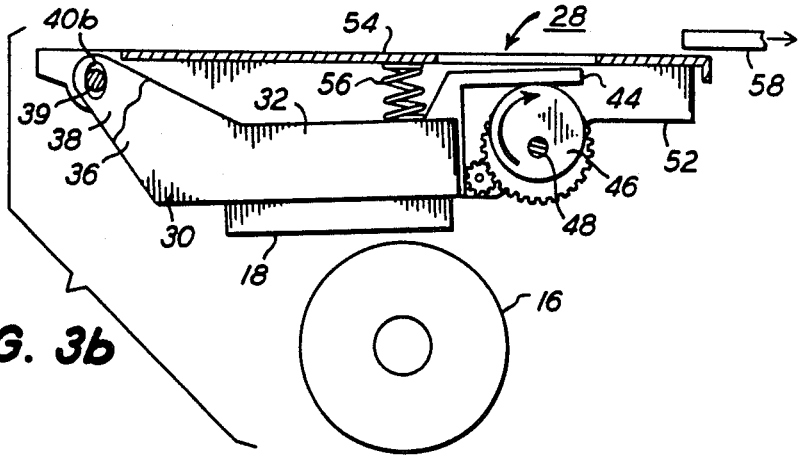

After the drum 16 has rotated a receiver sheet through its three printing cycles and a full colored image is formed on the receiver, the thermal head 18 is lifted from its loaded position shown in FIG. 3*a* to an off-drum or open position shown in FIG. 3*b*. The drive mechanism 15 then continuous to rotate the drum 16 until the receiver 12 has been stripped off the drum 16. Holding the print head off of the drum 16 during receiver sheet loading and unloading prevents head drag on the drum 16 and allows the carrier 14 to remain in position without being removed from either spool 21 or 22.

Figure 2:
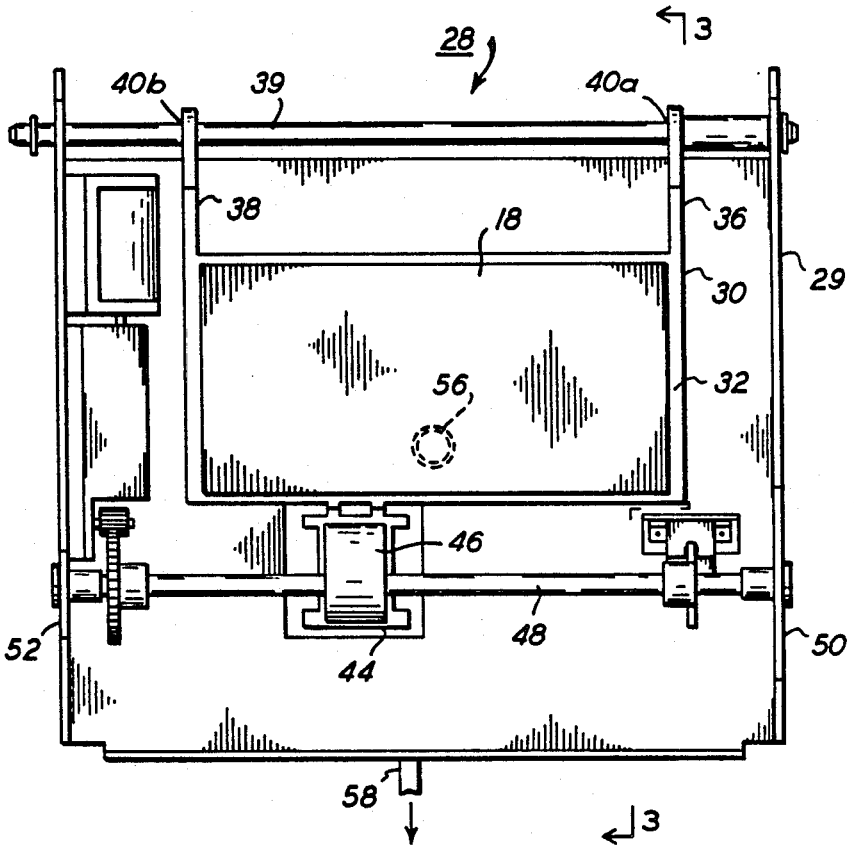
FIG. 2 is a bottom view of a compliant head loading mechanism in accordance with the present invention.

Turning now to FIG. 2 where a bottom view of the head loading mechanism 28 is shown. The head loading mechanism includes two brackets, upper bracket 29 and lower bracket 30. The print head 18 is fixedly secured to a central portion 32 of the lower bracket 30 by means not shown. The bracket 30 includes two parallel arms 36 and 38 which are formed perpendicular the central portion 32. A pivot shaft 39 passes through holes 40*a* and 40*b* respectively formed in each of the pivot arms 36 and 38. The hole 40*a* is circular in configuration and is formed to provide a tight tolerance fit relative to the fixed pivot shaft 39 so as to permit only rotational motion of the bracket 30. The second hole 40*b* is a slot and is arranged so that the lower bracket 30 can both translate and rotate in such slot.

The slot 40*b* has major and minor axes. The slot 40*b* is aligned so as to prevent the drag forces of the rotating drum 16 on the media from inducing twist in the lower bracket 30. The slot tilt permits the lower bracket 30 to comply to the drum surface at the nip. When the head 18 is loaded and the drum 16 is turning, without the proper slot tilt, a twisting moment is induced in the lower bracket. The slot 40*b* is aligned so that the major axis of the slot is perpendicular to a line running from the printing nip to the center axis of the pivot shaft 39. This prevents the twisting moment. Uniform loading force is thereby uniformly distributed across the nip.

Figure 4A:
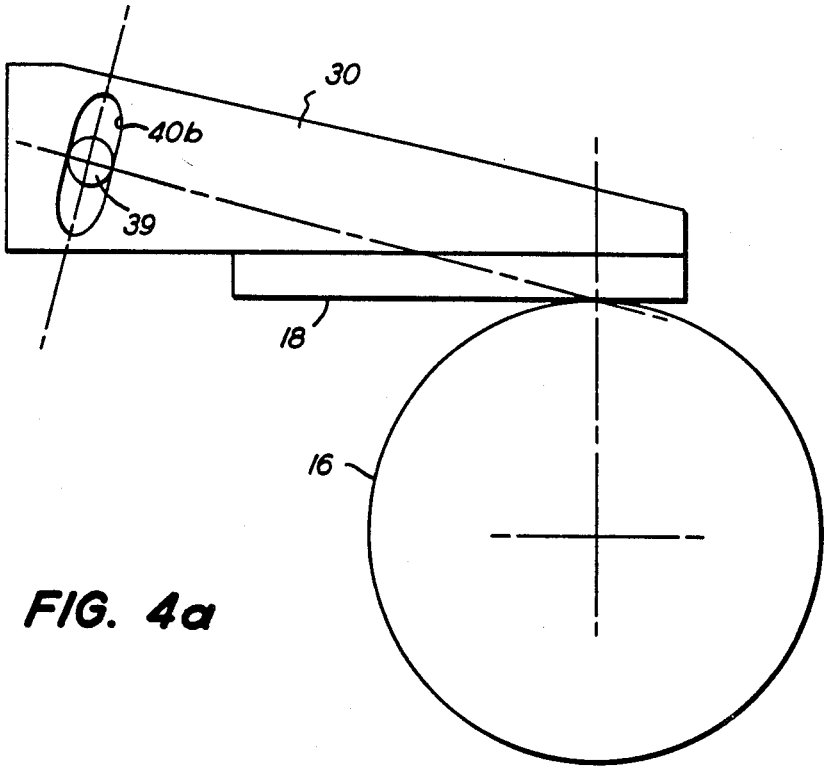
FIGS. 4*a* and 4*b* respectively show in schematic different slot alignment arrangements in accordance with the invention.
Figure 4B:
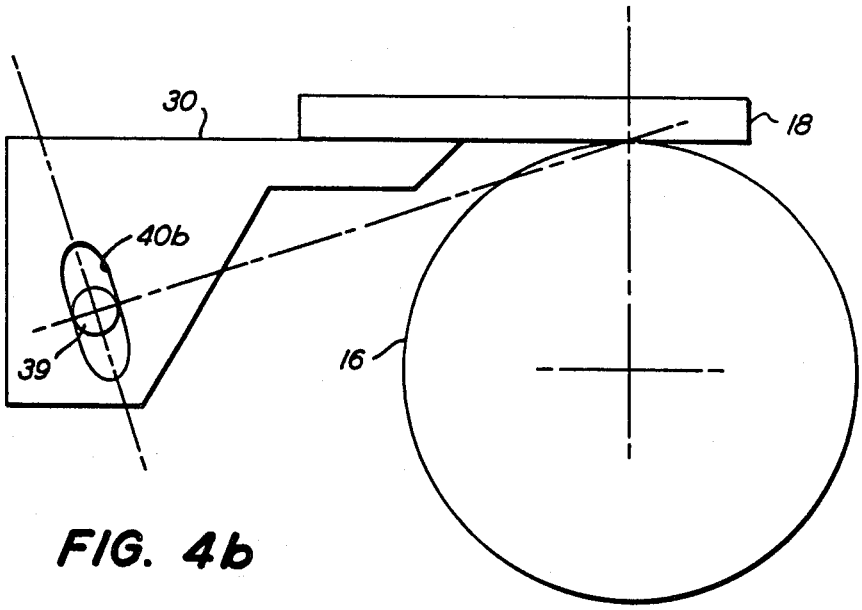

Turning now to FIGS. 4*a* and 4*b* which show in schematic form different constructions of the lower bracket. In both these cases the slot 40*b* is arranged so that its major axis is perpendicular to a line drawn between the center axis of the shaft and the printing nip.

The lower bracket 30 includes a free end portion 44 which is engageable by a cam 46. The cam 46 is fixedly secure to a rotatable shaft 48 which is mounted in arms 50 and 52 of the upper bracket 29. A compression spring 56 is fixedly secure to the central portion 54 of the upper bracket 29 and the central portion 32 of the lower bracket 30. As shown in FIG. 3*a* in the loaded position, the spring 56 causes the lower bracket 30 to move such that the head is driven into engagement with the drum 16.

Figure 3C:
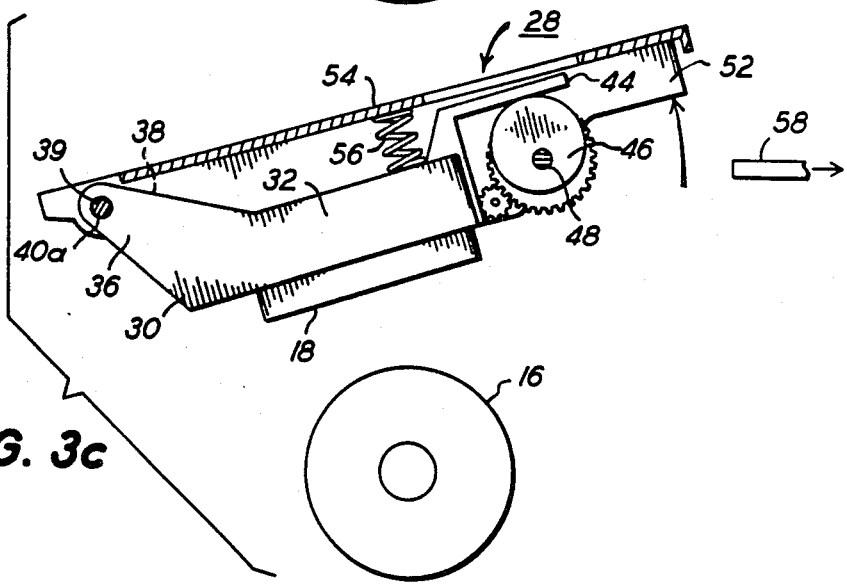

In FIGS. 3*a–c*, the receiver sheet 12 and the carrier 14 are not shown for simplicity of illustration. As noted in FIG. 3*a*, the lift cam 46 has its profile shaped such that is is actually spaced from the free-end portion 44. After a particular color frame has been formed in the receiver sheet, lift cam 46 is rotated to the position shown in FIGS. 3*b*, engages the end portion 44 and drives the lower bracket 30 upwardly so that the print head 18 is spaced from the drum 16. A latching mechanism 58 securely latches the upper bracket 29 in the position shown in FIG. 3*a* and 3*b*, during the operation of the thermal printing apparatus when a full colored image is being formed. When the apparatus is to be serviced, the latch 58 is manually removed from disengagement with the upper bracket 29 and both the upper and lower brackets can be pivoted to the position shown in FIG. 3*c*. In this position, the compression spring 56 moves the lower bracket downwardly to a position so that its free end portion 44 engages the cam 46. This arrangement allows the head loading mechanism to be swung away from the drum while still holding the two brackets together.

The arms of the upper bracket each includes holes to permit this bracket to be pivotably mounted on the fixed pivot shaft. There is no need for these holes to have a tight tolerance. Also, although not shown, it will be understood that a small DC motor can be used to drive the lift cam 46. This motor may also be controlled by the microcomputer 17 shown in FIG. 2. Further, web sensing apparatus can also be mounted on the upper bracket 29.

The invention has been described in detail with particular reference to a preferred embodiment thereof, but it will be understood that variations and modifications can be effected within the spirit and scope of the invention.

We claim:

1. Compliant print head loading mechanism for a thermal printer which in a loaded condition compliantly loads a thermal head against a dye-carrier and a receiver mounted on a platen such as a drum to form a nip, comprising:

(a) a fixed pivot shaft;

(b) a lower bracket fixed securely to said thermal head and having two arms each having a hole that receives said pivot shaft to pivotably mount said lower bracket, one of said holes being a tight tolerance hole that only permits rotational motion of said lower bracket and the other hole being in the form of a slot with major and minor axes constructed to permit both rotational and translation motion of said lower bracket, said slot being configured such that a line extending from the nip and the center axis of said pivot shaft is perpendicular to said major slot axis;

(c) an upper bracket pivotably mounted on said pivot shaft and movable between unloaded and loaded positions;

(d) a rotatable cam member;

(e) a head loading spring fixedly connected between said upper and lower brackets and effective to urge said lower bracket into engagement with said cam member; and (f) said cam member being configured and located to move said print head into and out of a loaded condition, wherein said thermal head is compliantly loaded by said spring to form said nip, whereby the loading force is uniformly distributed across the nip and no twisting moment is induced in said lower bracket.

* * * * *